US006295432B1

(12) United States Patent
Inoue et al.

(10) Patent No.: US 6,295,432 B1
(45) **Date of Patent: *Sep. 25, 2001**

(54) IMAGE FORMING APPARATUS HAVING AN INJECTION CHARGING SYSTEM AND A TWO COMPONENT CONTACT DEVELOPMENT DEVICE

(75) Inventors: Masahiro Inoue, Mishima; Yoshiaki Kobayashi, Numazu; Kenichiro Waki, Susono; Masaru Hibino, Minamiashigara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 80 days.

(21) Appl. No.: 08/997,530

(22) Filed: Dec. 23, 1997

(30) Foreign Application Priority Data

Dec. 24, 1996 (JP) ..... 8-355652

(51) Int. Cl.[7] ..... G03G 15/00; G03G 15/08

(52) U.S. Cl. ..... 399/270; 399/55; 399/174; 430/122

(58) Field of Search ..... 399/43, 53, 55, 399/270, 267, 252, 174, 175, 168, 176; 430/122, 108

(56) References Cited

U.S. PATENT DOCUMENTS

| | | | | |
|---|---|---|---|---|
| 4,486,525 | * | 12/1984 | Yamaoka | 430/122 |
| 4,578,337 | * | 3/1986 | Oka | 430/122 X |
| 5,296,328 | * | 3/1994 | Fuji et al. | 430/122 |
| 5,592,264 | * | 1/1997 | Shigeta et al. | 399/175 |
| 5,606,401 | * | 2/1997 | Yano | 399/175 |
| 5,669,050 | | 9/1997 | Sakemi et al. | 399/270 |
| 5,689,777 | * | 11/1997 | Yamamoto et al. | 399/174 |
| 5,724,632 | * | 3/1998 | Arahira et al. | 399/174 |
| 5,937,245 | * | 8/1999 | Inoue et al. | 399/175 |

FOREIGN PATENT DOCUMENTS

| | | |
|---|---|---|
| 0 661 607 | 7/1995 | (EP) . |
| 08 050398 | 2/1996 | (JP) . |
| 08 160725 | 6/1996 | (JP) . |

OTHER PUBLICATIONS

Patent Abstracts of Japan, vol. 1996, No. 06, Jun. 28, 1996.
Patent Abstracts of Japan, vol. 1996, No. 10, Oct. 31, 1996.

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member for carrying an electrostatic image, a contact charger for electrically charging the image bearing member while contacting to a surface of the image bearing member, the contact charger forming an oscillating electric field having a frequency of 100–600 Hz; a developer for developing the electrostatic image on the image bearing member with a developer comprising toner and a carrier having a volume resistivity value of $10^6$–$10^{10}$ Ω.cm, while contacting chains of the carrier to the image bearing member, the developer including a developer carrying member, opposed to the image bearing member, for carrying the developer and electric field forming device for forming an alternating electric filed between the image bearing member and the developer carrying member; wherein the following relationship are satisfied:

$$5\times10^{-5}<T_1<1\times10^{-4}\text{(sec); and}$$

$$5\times10^{-5}<T_2<1\times10^{-4}\text{(sec);}$$

where $T_1$ is a time duration in which the toner receives force away from the image bearing member toward the developer carrying member; and wherein $T_2$ is a time duration in which the toner receives force away from the developer carrying member toward the image bearing member.

25 Claims, 8 Drawing Sheets

IMAGE FORMING APPARATUS HAVING AN INJECTION CHARGING SYSTEM AND A TWO COMPONENT CONTACT DEVELOPMENT DEVICE

FIELD OF THE INVENTION AND RELATED ART

The present invention relates to an image forming apparatus such as a copying machine or printer, more particularly to a developing device for developing an electrostatic image on an image bearing member through a two component contact developing method.

Referring first to FIG. 6, a conventional image forming apparatus will be described.

In this Figure, an original G is placed on an original carriage 10 with the side to be copied facing down. Upon depressing a copy key, the copying operation starts. A unit 9 integrally having a lamp for original projection, a short focus lens array and a CCD sensor, effects a scanning operation while illuminating the original, so that light reflected by the original surface is imaged on a CCD through a short focus lens array.

The sensor comprises a light receiving portion, a transfer portion and an output portion, wherein the light receiving CCD portion converts the light signal to a charge signal, the transfer portion sequentially transfers the charge signal to the output portion in synchronism with clock pulses, and the output portion changes the charge signal to a voltage signal, which is then amplified and is subjected to an impedance reduction treatment. The analog signal thus provided is subjected to a known image processing operation to be converted to digital signals.

The printer portion receives the image signal and forms an electrostatic latent image in the following manner. The photosensitive drum 1 is rotated in the direction indicated by the arrow at a predetermined peripheral speed about an axis thereof, and the surface thereof is uniformly charged by a charger 3 to approx. −650V during the rotation process. Then, the uniformly charged surface thereof is scanned by a beam deflected by a rotatable polygonal mirror rotating at a high speed, wherein the beam is emitted by a solid laser element and is rendered on and off in accordance with the image signal.

The electrostatic latent image is developed by toner by a developing device 4 into a toner image which is in turn electrostatically transferred onto a transfer material P by a transfer charger 7. Thereafter, the transfer material P is electrostatically separated from the drum by a separation charger 8, and is fed to a fixing device 6 in which the image is fixed, and then is outputted.

On the other hand, the surface of the photosensitive drum 1 after the image toner image transfer, is cleaned by a cleaner 5 so that deposited contamination such as residual toner is removed, and the photosensitive drum 1 is prepared for the next image formation operation.

Recently, a direct charging member has become used as a means for effecting a charging method not using a corona discharge with the increasing environment consciousness. Particularly, an injection charging type is highly desirable since the amount of discharge is extremely small when the photosensitive member is charged. The injection charging system includes a system in which the electric charge is injected to the trap potential of the photosensitive member surface material by a contact charging member to electrically charge it, and a system in which the electric charge is given to electroconductive particles of a charge injection layer in which the electroconductive particles are dispersed in the photosensitive member surface. It is known that in these cases, the charging efficiency is good when the volume resistivity of the surface layer of the photosensitive drum is approx. $10^9$–$10^{13}$ Ω.cm.

When the injection charging system is used with the photosensitive drum having an adjusted volume resistivity of the surface layer of $10^9$–$10^{13}$ Ω.cm approx., the charging efficiency is good, but the background fog is produced, and the image density of the output is low. It has been found that fog and image density decrease occurs when the development operation is carried out for the surface layer of the photosensitive member having the adjusted volume resistivity of $10^9$–$10^{13}$ Ω.cm, under application of alternating electric field and using two component developer.

Various experiments and investigations have been made about the phenomenon of the fog production and the image density decrease, and it has been found that a charge is injected, during the developing operation, from the magnetic carrier into the photosensitive drum having the volume resistivity of the surface layer of approx. $10^9$–$10^{13}$ Ω.cm.

The photosensitive drum having the surface layer volume resistivity of $10^9$–$10^{13}$ Ω.cm approx. can be charged by rubbing the surface thereof with magnetic particles such as ferrite particles of a particle size of not more than 100 μm approx. preferably 15–50 μm carried on a charging sleeve containing therein a magnet, while a bias voltage is applied.

The developer carrier preferably has a volume resistivity of $10^6$–$10^{10}$ Ω.cm since then an electrode effect is provided. It has been found that phenomenon similar to the injection charging unintentionally occurs during the development operation using the magnetic carrier having a volume resistivity of approx. $10^9$–$10^{10}$ Ω.cm, particularly when the two component development operation is carried out wherein the magnetic carrier is contacted to the photosensitive drum.

It is also known in the injection charging that charging efficiency is good when an alternating electric field having a frequency of 100–6000 Hz preferably 500–2000 Hz is superimposed on DC. It is considered that same phenomenon occurs when the use is made with a developing method which is known per se if the two component development is carried out using the magnetic carrier and the developing bias containing an alternating electric field component of frequency 2000 Hz for the purpose of the development efficiency improvement and the image quality improvement.

When a reverse development operation is carried out for a photosensitive drum having an adjusted surface layer volume resistivity of approx. $10^9$–$10^{13}$ Ω.cm with a two component developer including a magnetic carrier having a volume resistivity of approx. $10^6$–$10^{10}$ Ω.cm and with an alternating electric field having a frequency of approx. 100–3000 Hz, the charge injection unintentionally occurs in the developing zone from the magnetic carrier for the development into the photosensitive drum with the result that the potentials of the white portion (the portion not exposed to the light after the uniform charging) and the black portion (the portion exposed to the light after the uniform charging) converges to the potential of the DC component of the voltage applied to the developing sleeve. Therefore, the potential difference between the white background portion and the developing sleeve reduces with the result of fog production and of the decrease of the image density because of the decrease of the potential difference between the black portion and the developing sleeve.

In the forgoing analysis, the reverse developing system is taken, but the problem is not peculiar to the reverse development system, and the same problem also arises with the regular developing system.

SUMMARY OF THE INVENTION

Accordingly, it is a principal object of the present invention to provide an image forming apparatus wherein a toner image having a high image quality can be formed on an image bearing member having a surface layer surface resistivity of $10^9$–$10^{13}$ Ω.cm.

It is another object of the present invention to provide an image forming apparatus wherein a bias voltage does not leak into the image bearing member through a carrier.

It is a further object of the present invention to provide an image forming apparatus wherein an injection charging system and a two component contact development can be used together with each other.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 2:
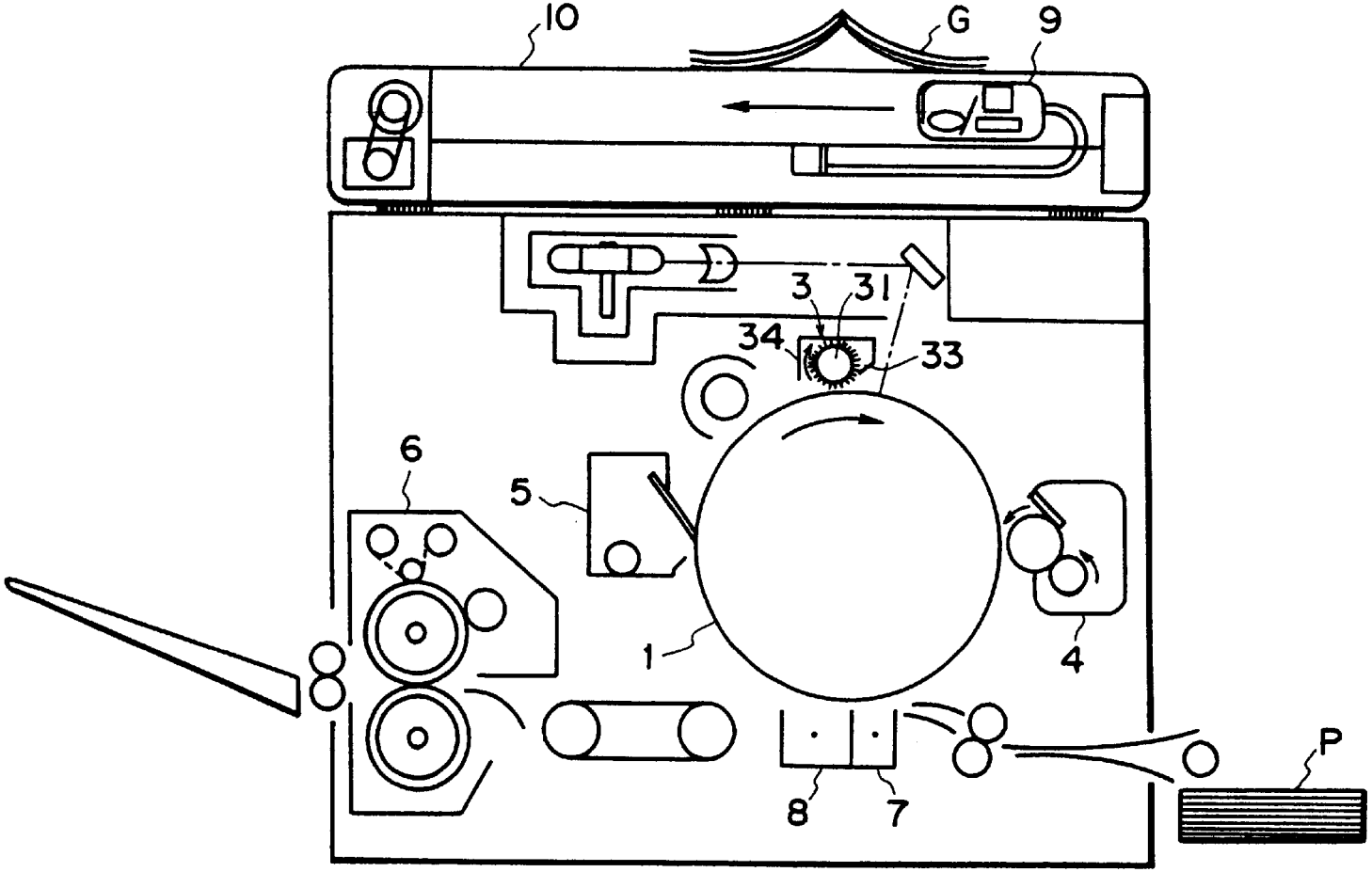
FIG. 2 is a schematic illustration of image forming apparatus according to an embodiment of the present invention.
Figure 6:
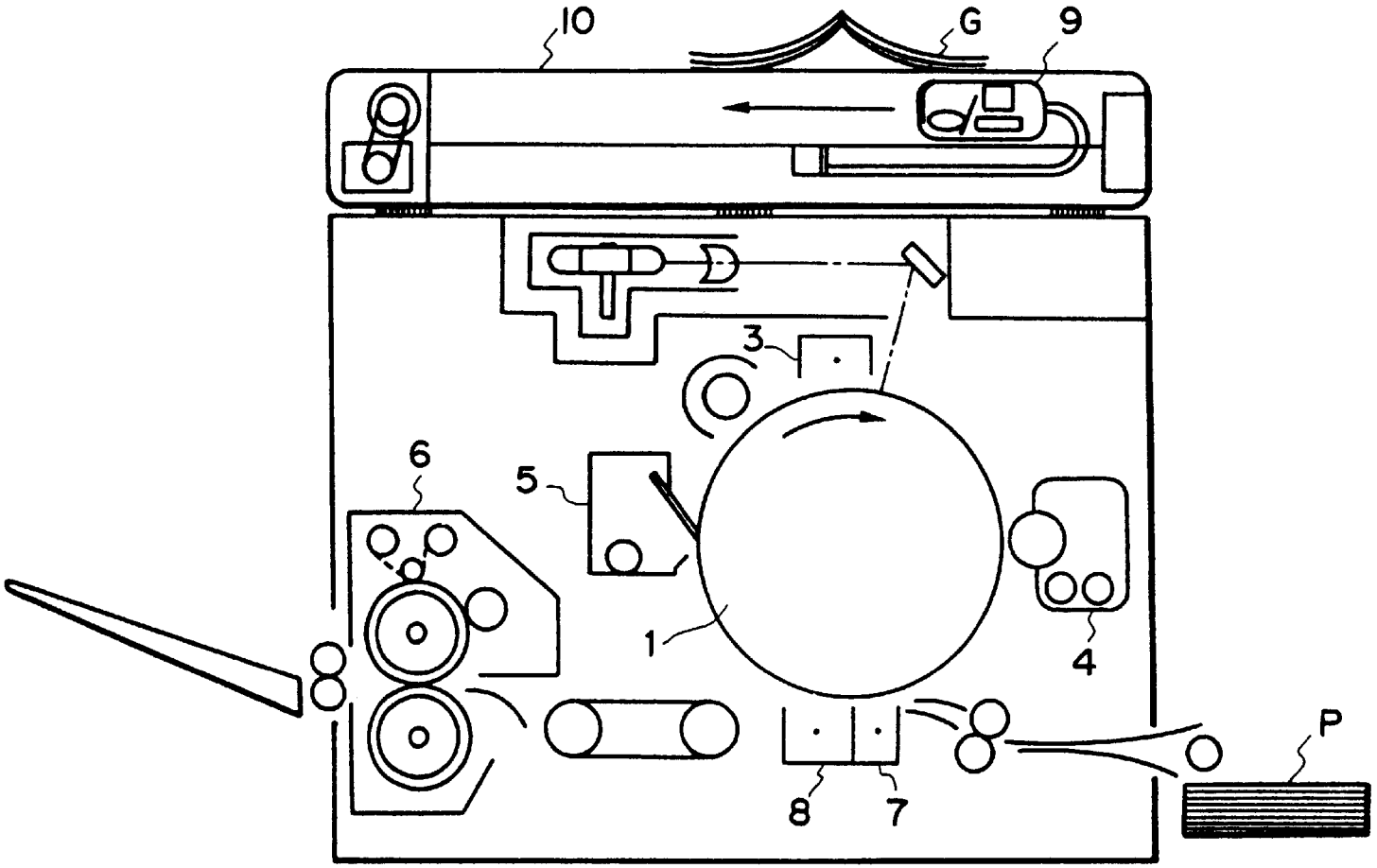
FIG. 6 PRIOR ART
FIG. 6 is an illustration of an example of a conventional image forming apparatus.

FIG. 2 is a sectional view of an image forming apparatus according to an embodiment of the present invention. The same reference numerals as in FIG. 6 are assigned to the elements having the corresponding functions, and detailed descriptions thereof are omitted for simplicity.

Figure 7:
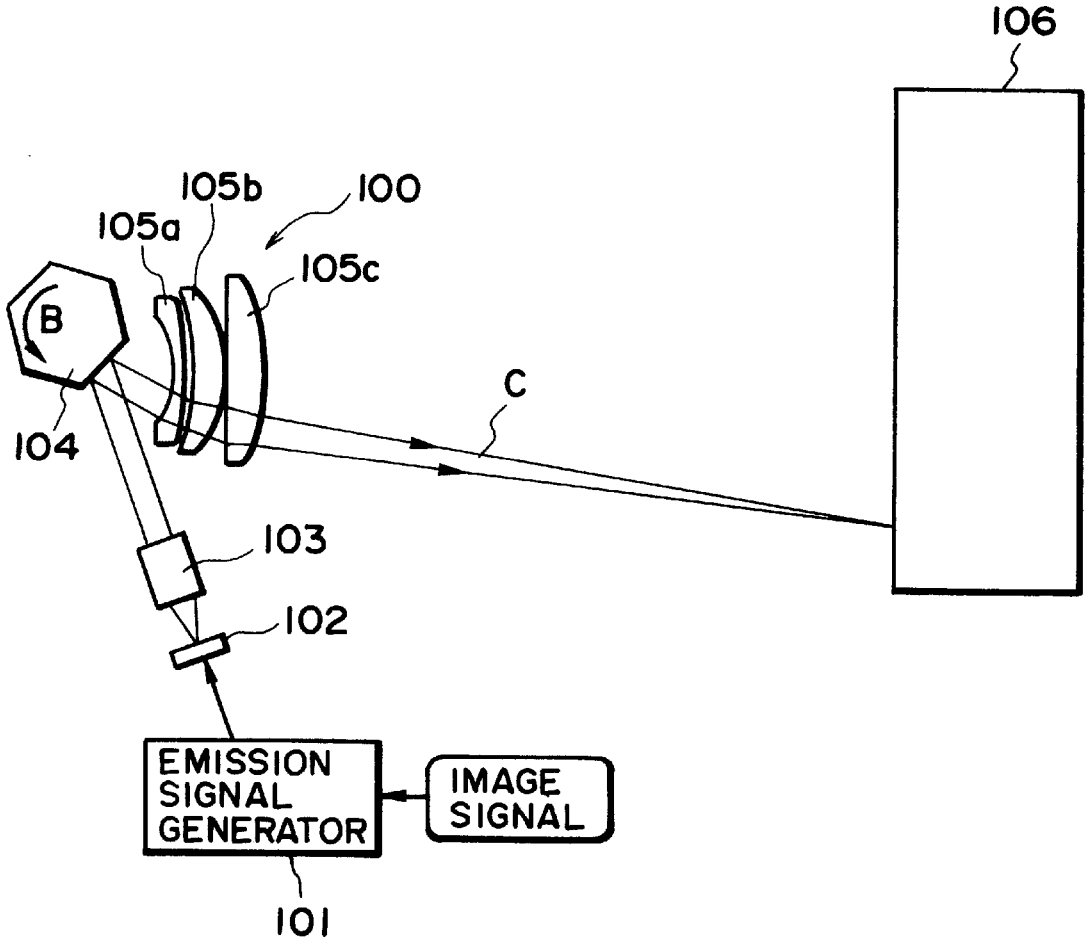
FIG. 7 is an illustration of an exposure device used in the image forming apparatus of FIG. 2.

FIG. 7 shows a schematic structure of a laser scanner 100 for scanning with a laser beam. When the photosensitive member is scanned with the laser beam by a laser scanner 100, the solid laser element 102 is rendered on and off at predetermined timing by an emission signal generator 101 in accordance with image signals supplied thereto. The laser beam emitted from the solid laser element 102 is collimated by a collimator lens 103 into a substantially a focal beam, and is deflected in the direction of an arrow C by a rotatable polygonal mirror 104 rotating in the direction of arrow B, and is imaged as a spot on a surface to be scanned 106 such as a photosensitive drum 1 through a f-theta group of lenses 105*a*, 105*b*, 105*c*. By the scanning with the image signal, an exposure distribution of one scan line is provided on the surface to be scanned 106, then the surface to be scanned 106 is scrolled by a predetermined degree in a direction perpendicular to the direction of the scanning after each scan, by which an exposure distribution corresponding to the image signals is provided on the surface to be scanned 106.

The developing method will be described.

Generally, developing methods are grouped into four groups. In the first two groups, non-magnetic toner is applied on a sleeve by a blade or the like, or magnetic toner is applied thereon by magnetic force, and is carried to a developing zone, where it develops the image on the photosensitive drum while it is not contacted to the photosensitive drum(one component non-contact development); and in the third and fourth groups, the developer contains a magnetic carrier mixed with the toner and is applied in the similar manner on the sleeve and is then carried, using magnetic force, to the developing zone where it develops the image on the photosensitive drum while it is contacted to the photosensitive drum(two component contact development) or while the developer is not contacted to the photosensitive drum (two component non-contact development).

Among them, two component contact development is advantageous from the standpoint of a high resolution and a reproducibility of half-tone image, and therefore, the developing device of this example uses the two component contact development.

Figure 8:
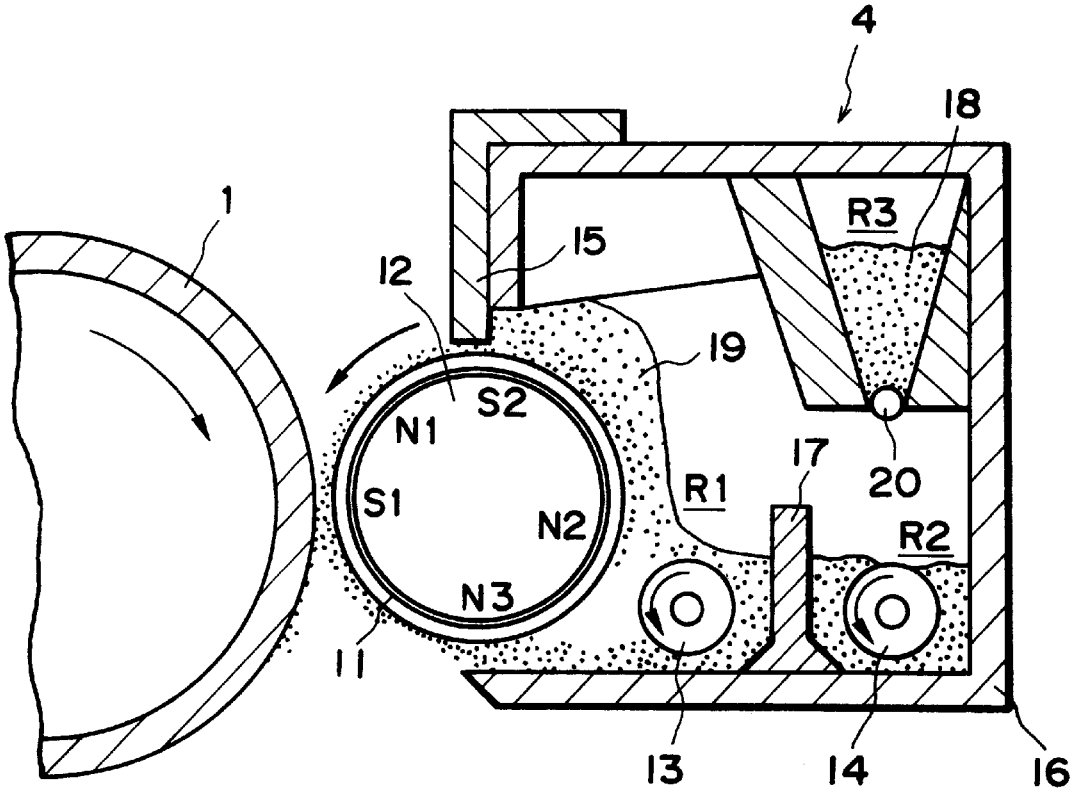
FIG. 8 is an illustration of the developing device used in the image forming apparatus of FIG. 2.

As shown in FIG. 8, the developing device 4 is provided with a developer container 16, and the inside of the developer container 16 is partitioned by a partition 17 into a developer chamber(first chamber) R1 and a stirring chamber (second chamber) R2, and a replenishing toner(non-magnetic toner) 18 is accommodated in the toner storing chamber R3. The bottom portion of the toner storing chamber R3 is provided with a supply opening 20 through which the replenishing toner 18 is let fall into the stirring chamber R2 in accordance with the consumption of the toner.

The developer chamber RI and a stirring chamber R2 contain the developer 19. The developer 19 is a two component developer comprising the non-magnetic toner and the magnetic particle(carrier). The mixing ratio is such that weight content of the non-magnetic toner is approx. 4–10%. The non-magnetic toner has a volume average particle size of approx. 5–15 μm. The magnetic particle comprises ferrite particles (maximum magnetization is 60 emu/g) coated with a resin material coating, and the weight average particle size is 25–60 μm, and the resistance thereof is $10^6$–$10^{10}$ Ω.cm. The magnetic permeability of the magnetic particle is approx. 5.0.

An opening is formed in the developer container 16 at a position adjacent to the photosensitive drum 1, and a half of the developing sleeve 11 is projected through the opening to the outside. The developing sleeve 11 is rotatable in the developer container 16. The outer diameter of the developing sleeve 11 is 32 mm, and the peripheral speed thereof is 280 mm/sec, and the developing sleeve 11 is rotated in the direction of the arrow indicated in the Figure, in this embodiment. The developing sleeve 11 is spaced from the photosensitive drum 1 by 500 μm (gap). The developing sleeve 11 is of a non-magnetic material, and a stationary magnet 12 (magnetic field generating means) is provided therein. The magnet 12 has a developing magnetic pole S1, a magnetic pole N3 positioned downstream thereof and magnetic poles N2, S2 and N1 for feeding the developer.

The magnet 12 takes such a position that developing magnetic pole S1 is faced to the photosensitive drum 1. The developing magnetic pole S1 forms a magnetic field adjacent a developing zone formed between the developing sleeve 11 and the photosensitive drum 1, and a magnetic brush is formed by the magnetic field.

At an upper part of the developing sleeve 11, a blade 15 is fixed on the developer container 16 such that blade 15 is spaced from the developing sleeve 11 by 800 $\mu$m to regulate a layer thickness of the developer 19 on the developing sleeve 11. The blade 15 is of non-magnetic material such as aluminum or SUS316 (stainless steel).

A feeding screw 13 is provided in the developer chamber R1. The feeding screw 13 is rotated in the direction of an arrow in the Figure, and the developer 19 in the developer chamber R1 is fed in the longitudinal direction of the developing sleeve 11 by rotation of the feeding screw 13.

A feeding screw 14 is provided in the storing chamber R2. The feeding screw 14 feeds toner in the longitudinal direction of the developing sleeve 11 by the rotation thereof, and the toner falls into the stirring chamber R2 through the supply opening 20.

The developing sleeve 11 catches the developer at the position adjacent the magnetic pole N2, and the developer 19 is fed toward the developing zone by the rotation of the developing sleeve 11. When the developer 19 reaches the neighborhood of the developing zone, a chain of the magnetic particle of the developer 19 is formed erecting from the developing sleeve 11 by the magnetic force of the magnetic pole S1 so that magnetic brush of the magnetic brush is formed.

The feature of the present invention will be described. As described hereinbefore, when a development operation is carried out for a photosensitive drum having an adjusted surface layer volume resistivity of approx. $10^9$–$10^{13}$ Ω.cm with a two component developer including a magnetic carrier having a volume resistivity of approx. $10^6$–$10^{10}$ Ω.cm, the potential difference between the white portion and the developing sleeve reduces with the result of fog production, and the potential difference between the black portion and the developing sleeve also decreases with the result of the decrease of the image density. The inventors have found that there is a developing bias which can avoid the problems.

More particularly, the problems can be avoided if the frequency of the alternating electric field superimposed in the developing bias to be applied to the developing sleeve is not less than 5 kHz.

The reason is considered as follows. Using such a high frequency for the alternating electric field, the carrier particles in the development gap do not make complete reciprocating motion between the photosensitive drum and the developing sleeve, but make vibrating motion adjacent the developing sleeve due to the force provided by the DC component of the developing bias, so that charge injection from the developing carrier into the photosensitive drum hardly occurs.

However, if the frequency of the developing. bias is simply increased, the reproducibility of a so-called high light portion having a low image density such as not more than 0.3, with the result of production of a rough image.

Figure 1:
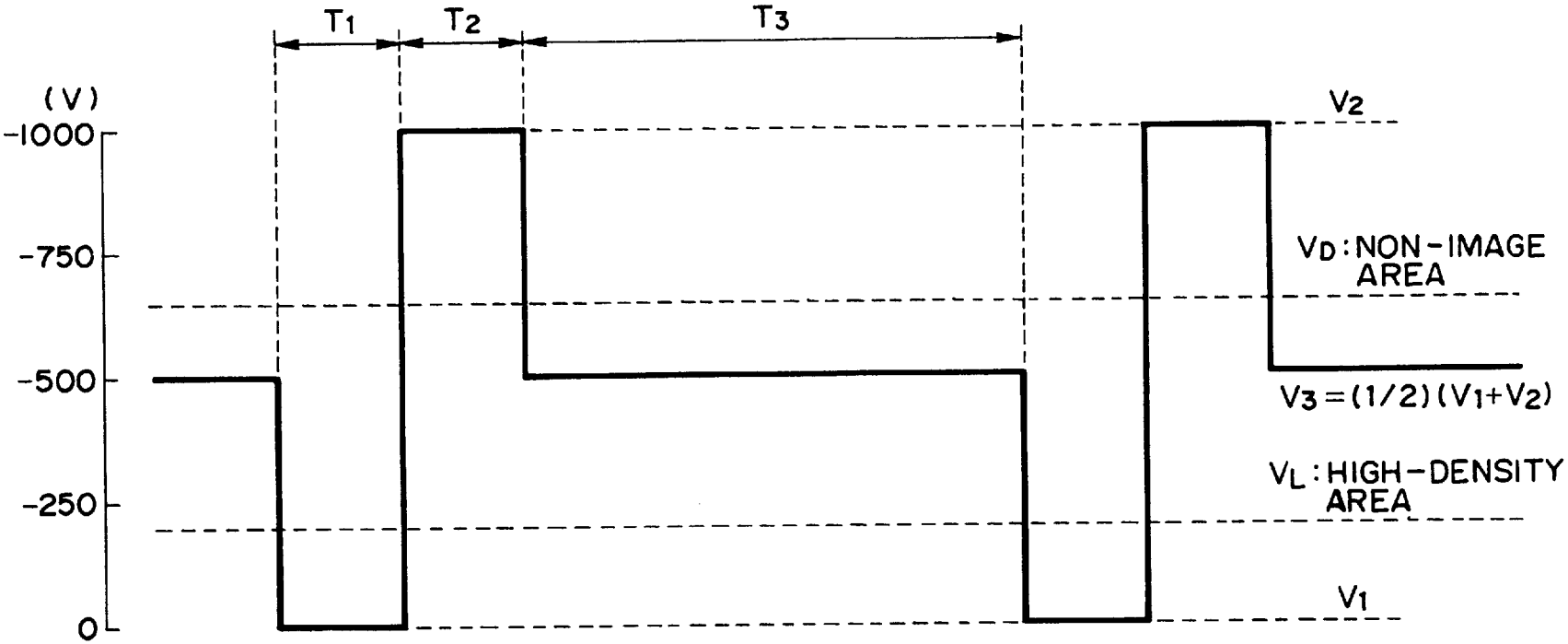
FIG. 1 is a waveform graph showing a waveform of a developing bias voltage used in an embodiment of the present invention.

The further investigations of the inventors has revealed a solution that application of the developing bias having a waveform shown in FIG. 1 between the developing sleeve 11 and the photosensitive drum 1 permits the image formation without the image roughness and without the decrease of the image density or the fog.

Referring to FIG. 1, the developing bias used in this embodiment will be described.

After a back-transfer voltage $V_1$ is applied for the time $T_1$, a transfer voltage $V_2$ is applied for $T_2$, and then a voltage corresponding the DC bias determined in consideration of fog removal in the non-image portion, that is, a blank voltage $V_3=(½)(V_1+V_2)$ is applied for $T_3$.

In order to prevent the injection phenomenon by the development carrier into the photosensitive drum and to form an image without roughness, the application periods of the bias voltages are set as follows:

$$5\times10^{-5}<T_1<1\times10^{-4}(\text{sec})$$

$$5\times10^{-5}<T_2<1\times10^{-4}(\text{sec})$$

$$(T_1+T_2)<T_3<5(T_1+T_2)(\text{sec})$$

Because of the setting of the bias application period, the alternating electric field portion has a high frequency not less than 10 kHz, and therefore, the charge injection through the magnetic carrier to the photosensitive drum hardly occurs in the developing zone so that problem of the decrease of the image density stemming from the decrease of the potential difference between the white background portion and the developing sleeve can be avoided.

Since a bias comprising only the DC component is applied for the time period which is approx. 1 time–5 times the total period of the applications of the alternating electric fields, after the application of the alternating electric field, there is sufficient time for the toner jumped from the developing sleeve to deposit on the photosensitive drum, and therefore, the image roughness of the high light portion can be removed.

The bias comprising only the DC component is applied for the time period which is approx. 1 time–5 times the total period of the applications of the alternating electric fields, since if it is less than 1 time, the time sufficient for the toner to deposit on the photosensitive drum is not provided, and since if it is longer than 5 times, the toner loosening effect, by the alternating electric field, for the toner on the developing sleeve is insufficient.

Figure 4:
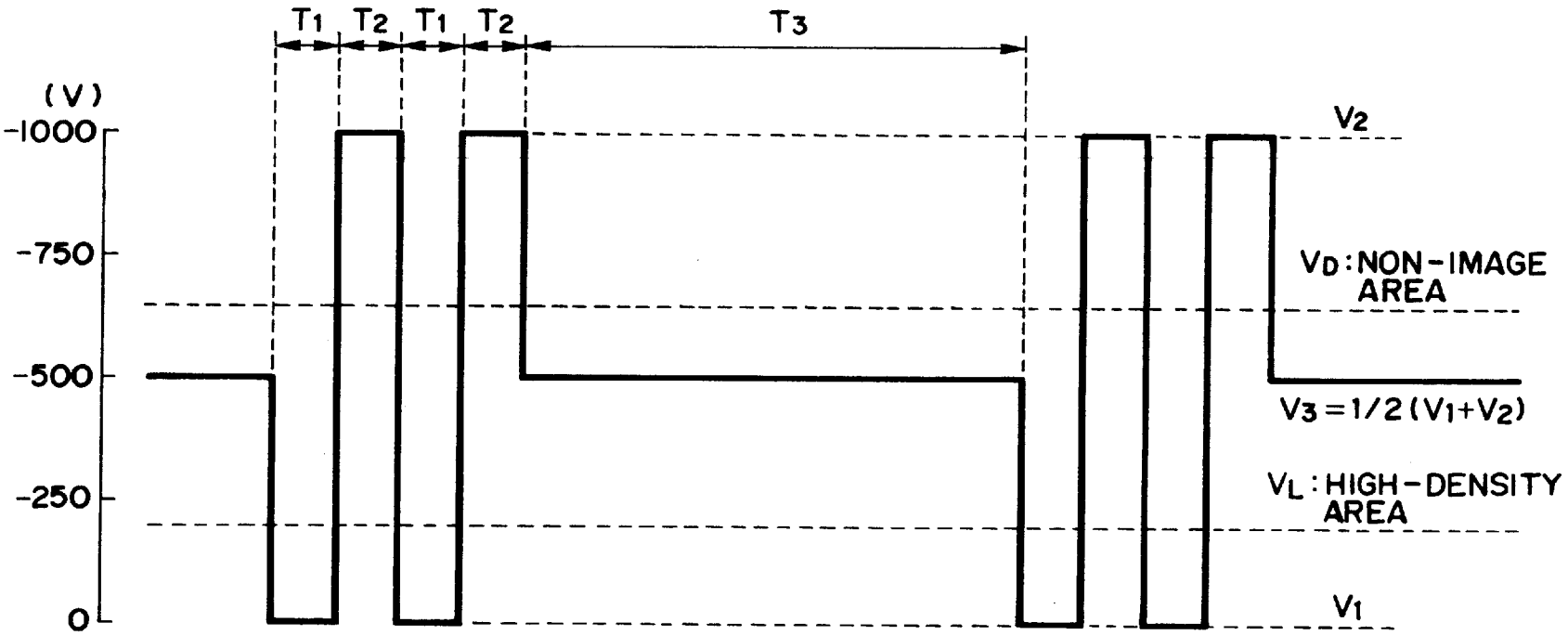
FIG. 4 is a waveform graph showing a waveform of another developing bias voltage according to an embodiment of the present invention.
Figure 5:
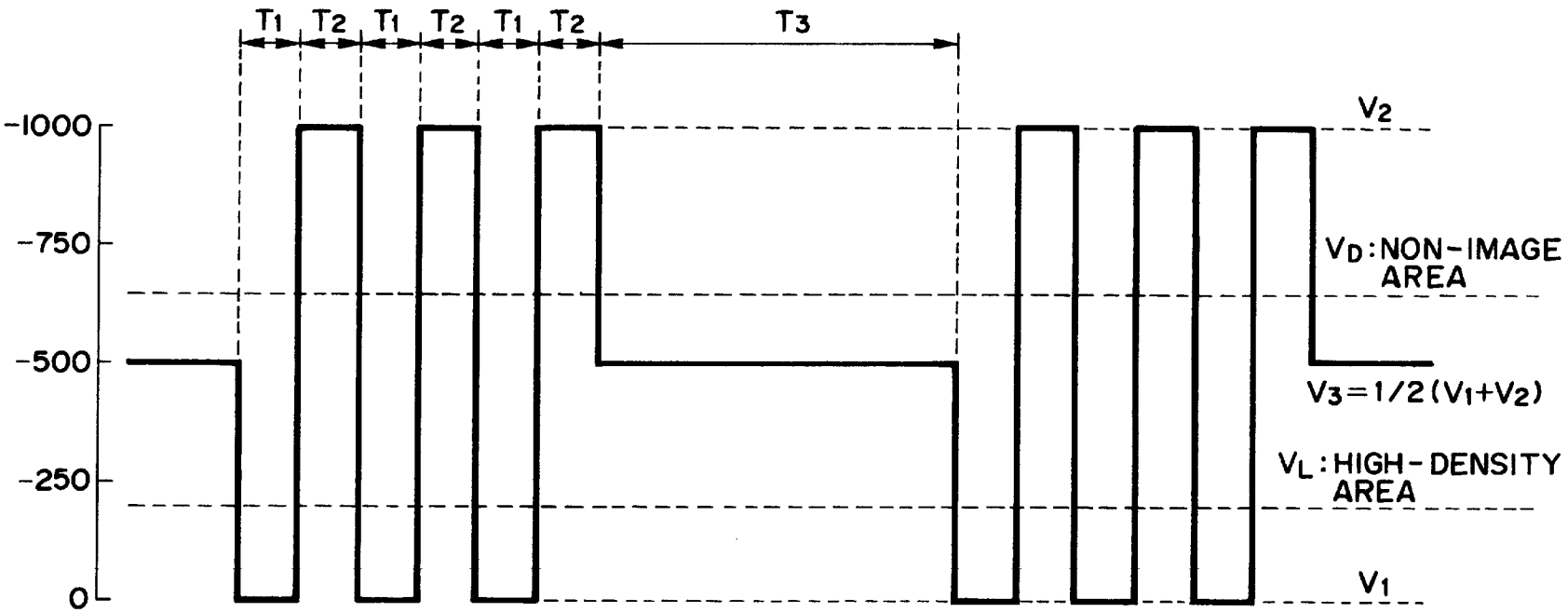
FIG. 5 is a waveform graph showing a waveform of a further developing bias voltage according to an embodiment of the present invention.

The present invention is not limited to the developing bias shown in FIG. 1. For example, two sets of the bias voltages shown in FIG. 4, three sets of the bias voltages shown in FIG. 5, in other words, a plurality of sets of the bias voltages, are usable with the same advantageous effects.

Figure 3:
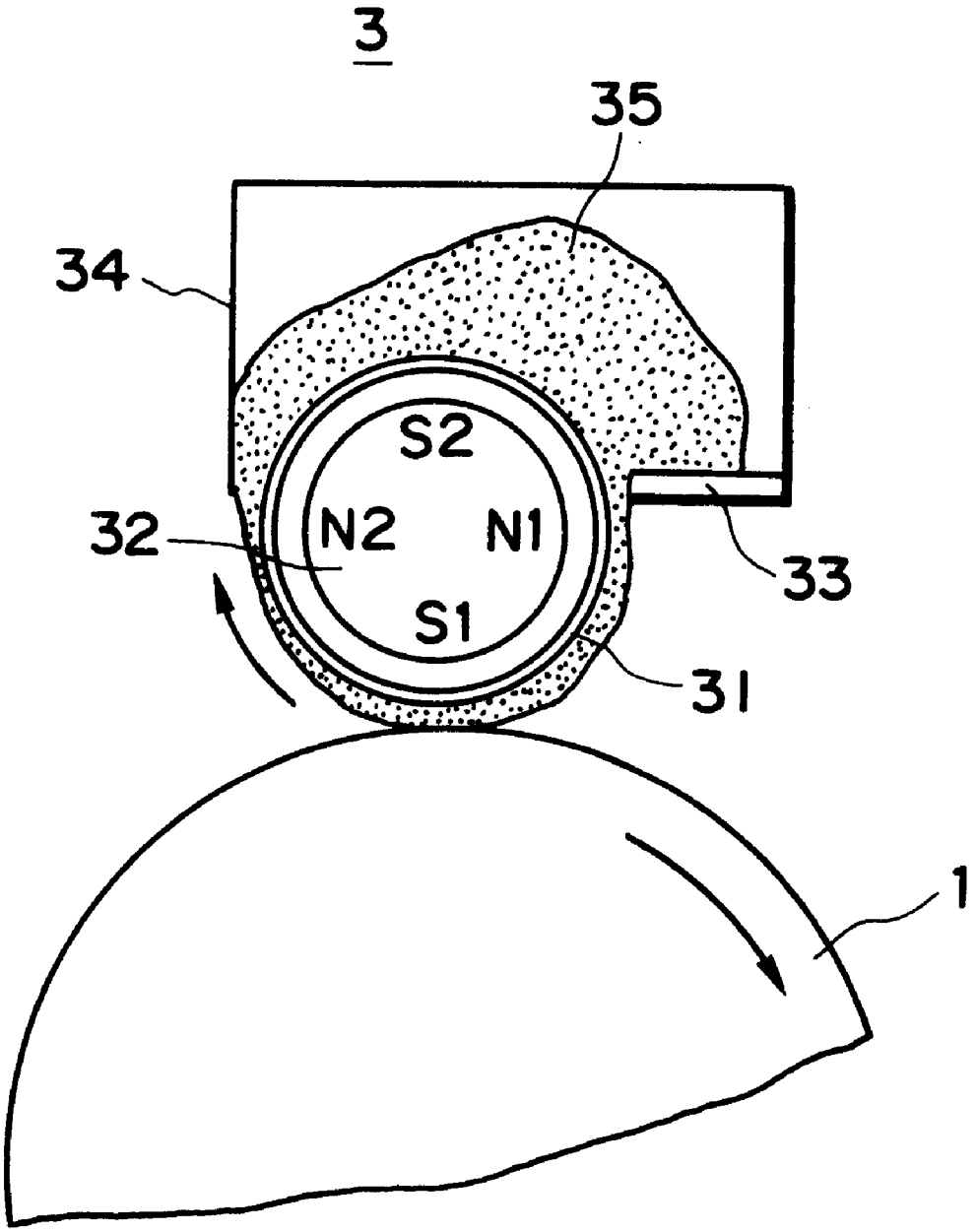
FIG. 3 is an illustration of a charger used in the image forming apparatus of FIG. 2.

Referring to FIG. 3, the description will be made as to a charger 3 according to an embodiment of the present invention. The charger 3 comprises a container 34, a sleeve 31 containing a stationary magnet 32, magnetic particles 35 for injection charging, a regulating member 33 for applying the magnetic particles 35 on the sleeve 31, wherein the sleeve 31 is rotated in such a direction that sleeve 31 surface moves in the opposite direction as the movement direction of the photosensitive member 1 as shown by the arrows at the portion where the magnetic particles 35 are in rubbing contact with the photosensitive member 1.

The charging magnetic particles 35 may be produced by:

Kneading resin material and magnetic powder member such as magnetite and reforming it into powder with or without electroconductive carbon or the like mixed therewith for resistance value control:

Sintered magnetite or ferrite with or without deoxidization or oxidation treatment for resistance value control:

Coating any of the above magnetic particles with a coating material (for example, carbon dispersed phenolic resin) having an adjusted resistance or plating any of the above magnetic particles with metal such as Ni to provide a proper resistance value.

As for the resistance value of the charging magnetic particle 35, if it is too high, the charge injection into the photosensitive member is non-uniform with the result of fog image due to fine defects of charging. If, on the contrary, it is too small, the electric current may concentrate on a pin hole, if any in the photosensitive member surface, with the result of drop of the charged voltage and therefore incapability of charging the photosensitive member surface and occurrence of improper charging extending in a direction of the charging nip. In view of these circumstances, the resistance value of the magnetic particles is preferably $1\times10^2$–$1\times10^{10}$ Ω and further preferably not less than $1\times10^6$ Ω from the standpoint of preparation for existence of a pin hole on the photosensitive drum. The resistance value of the charging magnetic particle is measured in the following manner: 2 g of the charging magnetic particles are placed in a metal cell which has a bottom area of 228 $mm^2$ and to which a voltage can be applied, and a pressure is applied thereto, and then the resistance is measured with the application of a voltage of 100V.

As for the magnetic property of the charging magnetic particles, the magnetic confining force is desirably high in order to prevent the magnetic particle deposition onto the drum, more particularly, the saturation magnetization thereof is desirably not less than 100 (emu/$cm^3$).

Actually, the charging magnetic particle used in this embodiment has an average particle size of 30 μm, a resistance value of $1\times10^6$ Ω and a saturation magnetization of 200 (emu/$cm^3$).

By application of a bias voltage of −650V to the charging sleeve 31, the photosensitive member 1 is uniformly charged to −650V. Then, the image is formed through steps described hereinbefore in conjunction with the prior art.

The charger 3 may be a corona charger, but the injection charging system is a desirable system since the amount of discharge during the charging action for the photosensitive member is extremely small, and therefore, the contamination of the photosensitive member surface with the discharge product or the like can be minimized.

The photosensitive drum 1 of types "A," "B," and "C" used in the following embodiments will be described.

Photosensitive Drum A:

It comprises a drum base of aluminum having a diameter of 30 mm, a first layer which is a lining layer in the form of an electroconductive layer having a thickness of 20 μm for preventing production of moire due to reflection of the exposure light. There is provided a second layer which is a positive charge injection preventing layer and functions to prevent cancellation of negative charge on the photosensitive drum surface by the positive charge injected from the drum base. It is an intermediate resistance layer having a thickness of approx.0.1 μm and having a volume resistivity of approx. $10^6$ Ω.cm adjusted by AMILAN (tradename of polyamide resin material, available from Toray Kabushiki Kaisha, Japan) resin material and methoxymethyl nylon. There is further provided a third layer which is a charge generating layer and functions to generate couples of electric charge by exposure. It is produced by resin material dispersion of a disazo pigment into a thickness of approx. 0.3 μm. There is further provided a fourth layer which is a charge transfer layer. It is produced by dispersing hydrazone in polycarbonate resin material, and is a p type semiconductor. There is further provided a fifth layer which is a surface layer. It is produced by dispersing low resistance particles such as $SnO_2$ (5parts by weight) in a polycarbonate resin material (3parts by weight) to reduce the surface resistivity. It has a thickness of 2 μm. The surface resistivity thereof is $10^{13}$ Ω.cm. By controlling the surface resistivity in this manner, the direct charging property is increased so that high quality image can be produced. The photosensitive drum is not limited to an OPC photosensitive drum, but a-Si drum, which is high in durability, is also usable.

The volume resistivity of the surface layer is measured as follows. Metal electrodes a disposed with a gap of 200 μm therebetween. Surface layer liquid is supplied into the gap, and a film thereof is formed. Then, a voltage of 100V is applied across the electrodes. The measurement is carried out at a temperature of 23° C. and under a humidity of 50% RH.

An image formation operation was carried out using the photosensitive drum A described above in the image forming apparatus shown in FIG. 2 under the following developing conditions, and the fog and the image density on the transfer sheet were checked: Developing condition:

The developing sleeve 11 was supplied with a DC and AC voltage having a waveform shown in FIG. 1. The charge polarity of the toner was negative. In the waveform shown in FIG. 1:

Non-image portion surface potential $V_D$=−650V;

High density image portion surface potential $V_L$=−100V;

Back-transfer voltage $V_1$=0V;

Transfer (developing) voltage $V_2$=−1000V;

Blank voltage $V_3$=−500V;

$T_1$, $T_2$ and $T_3$:

$T_1=1\times10^{-4}$ sec;

$T_2=1\times10^{-4}$ sec;

$T_3=2.0\times10^{-4}$ sec.

The standards for the fog density are as shown in the following table:

TABLE 1

| Fog density D | fog | level |
|---|---|---|
| D < 0.5 | practically no fog | $L_A$ |
| 0.5 ≦ D < 1 | hardly any fog | $L_B$ |
| 1 ≦ D < 2 | slightly foggy | $L_C$ |
| 2 ≦ D < 3 | foggy | $L_D$ |
| D ≦ 3 | fairly foggy | $L_E$ |

The fog density was determined in the following manner. The reflection densities of the fog portion on the transfer sheet and the transfer sheet per se before the image formation, were measured using a densitometer TC-6DS available from TOKYO DENSHOKU CO_, LTD, Japan, and the fog density was determined by the following equation:

Fog density(%)=(reflection density of the fog on the transfer sheet)−(reflection density of the transfer sheet)

The image density was determined as a reflection density of the image on the transfer sheet was measured using a densitometer type 941 available from X-lite.

When the image formation was carried out under the above developing conditions, the fog density level was $L_A$ (Table 1), and the image density was not less than 1.4 without roughness in the high light portion, so that production of good images were confirmed.

Embodiment 2

The image forming apparatus shown in FIG. 2, and the photosensitive drum A was used. However, the developing conditions were as follows.

Developing Condition:

The developing sleeve 11 was supplied with a DC and AC voltage having a waveform shown in FIG. 1 from an unshown voltage source. The charge polarity of the toner was negative. In FIG. 1, The non-image portion surface potential $V_D$=−650V:

High density image portion surface potential $V_L$=−100V;

Back-transfer voltage $V_1$=+500V;

Transfer voltage $V_2$=−1500V;

Blank voltage $V_3$=−500V;

$T_1$, $T_2$ and $T_3$:

$T_1=8.0\times10^{-5}$ sec;

$T_2=8.0\times10^{-5}$ sec;

$T_3=8.0\times10^{-4}$ sec;

When the image formation was carried out under the above developing conditions, the fog density level was $L_B$ (Table 1), and the image density was not less than 1.5 without roughness in the high light portion, so that production of good images were confirmed.

Embodiment 3

In Embodiment 3, the photosensitive drum B was as follows: In place of the fifth layer of the photosensitive drum A described above, the fifth layer of this embodiment is produced by dispersing low resistance particles such as $SnO_2$ (5 parts by weight) in a polycarbonate resin material (2 parts by weight) to reduce the surface resistivity. It has a thickness of 2 $\mu$m. The surface resistance is $10^9$ Ωcm.

An image formation operation was carried out under the following developing conditions, and the fog and the image density on the transfer sheet were checked:

Developing Condition:

The developing sleeve 11 was supplied with a DC and AC voltage having a waveform shown in FIG. 1 from an unshown voltage source. The charge polarity of the toner was negative. In FIG. 1, The non-image portion surface potential $V_D$=−650V:

High density image portion surface potential $V_L$=−100V;

Back-transfer voltage $V_1$=0V;

Transfer (developing) voltage $V_2$=−1000V;

Blank voltage $V_3$=−500V;

$T_1$, $T_2$ and $T_3$:

$T_1=1\times10^{-4}$ sec;

$T_2=1.0\times10^{-4}$ sec;

$T_3=2.0\times10^{-4}$ sec.

When the image formation was carried out under the above developing conditions, the fog density level was $L_C$ (Table 1), and the image density was not less than 1.5 without roughness in the high light portion, so that production of good images were confirmed.

Embodiment 4

In this embodiment, the photosensitive drum B of Embodiment 3 was used, and the following developing conditions were used:

Developing Condition:

The developing sleeve 11 was supplied with a DC and AC voltage having a waveform shown in FIG. 1 from an unshown voltage source. The charge polarity of the toner was negative. In FIG. 1:

Non-image portion surface potential $V_D$=−650V;

High density image portion surface potential $V_L$=−100V;

Back-transfer voltage $V_1$=0V;

Transfer (developing) voltage $V_2$=−1000V;

Blank voltage $V_3$=−500V;

$T_1$, $T_2$ and $T_3$:

$T_1=8.0\times10^{-5}$ sec;

$T_2=8.0\times10^{-5}$ sec;

$T_3=8.0\times10^{-4}$ sec;

When the image formation was carried out under the above developing conditions, the fog density level was $L_C$ (Table 1), and the image density was not less than 1.5 without roughness in the high light portion, so that production of good images were confirmed.

Comparison Example 1

As a comparison example 1, the image forming apparatus shown in FIG. 2 and the photosensitive member A were used with the following developing conditions:

Developing Condition:

The developing sleeve 11 was supplied with a DC and AC voltage having a waveform shown in FIG. 1 from an unshown voltage source. The charge polarity of the toner was negative. In FIG. 1, Non-image portion surface potential $V_D$=−650V;

High density image portion surface potential $V_L$=−100V;

Back-transfer voltage $V_1$=0V;

Transfer (developing).voltage $V_2$=−1000V;

Blank voltage $V_3$=−500V;

$T_1$, $T_2$ and $T_3$:

$T_1=1.25\times10^{-4}$ sec;

$T_2=1.25\times10^{-4}$ sec $T_3=2.0\times10^{-4}$ sec.

When the image formation was carried out under the above developing conditions, the fog density level was high, level $L_D$ (Table 1), and the image density was only 1.3 with slight roughness in the high light portion, so that produced images were not good.

Comparison Example 2

As a comparison example 2, the image forming apparatus shown in FIG. 2 and the photosensitive member A were used with the following developing conditions:

Developing Condition:

The developing sleeve 11 was supplied with a DC and AC voltage having a waveform shown in FIG. 1 from an unshown voltage source. The charge polarity of the toner was negative. In FIG. 1, Non-image portion surface potential $V_D$=−650V;

High density image portion surface potential $V_L$=−100V;

Back-transfer voltage $V_1$=0V;

Transfer (developing) voltage $V_2$=−1000V;

Blank voltage $V_3$=−500V;

$T_1$, $T_2$ and $T_3$:

$T_1=5.0\times10^{-4}$ sec;

$T_2=5.0\times10^{-4}$ sec;

$T_3=0$ sec;

When the image formation was carried out under the above developing conditions, the fog density level was high, level $L_D$ (Table 1), and the image density was only 1.3 with slight roughness in the high light portion, so that produced images were not good.

As described in the foregoing, according to the present invention, the duration $T_1$ in which the toner receives the force in the direction toward the developer carrying member away from the image bearing member and the duration $T_2$ in which the toner receives the force in the opposite direction, are $5\times10^{-5}$–$1\times10^{-4}$ (sec), so that decrease of the image density due to leakage of the developing bias through the carrier to the image bearing member surface layer, can be prevented.

The roughness of the image in the high light portion can be prevented by satisfying the $(T_1+T_2)<T_3<5\times(T_1+T_2)$ since then the toner is substantially free of the moving force.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member for carrying an electrostatic image, said image bearing member having a surface layer having a volume resistivity of $10^9$ to $10^{13}$ Ωcm;

contact charging means for electrically charging said image bearing member while contacting a surface of said image bearing member;

developing means for developing an electrostatic image on said image bearing member with a developer comprising toner and a carrier, while contacting chains of the carrier to said image bearing member, said developing means including a developer carrying member, opposed to said image bearing member, for carrying the developer and electric field forming means for forming an alternating electric field between said image bearing member and said developer carrying member;

wherein the following relationships are satisfied:

$5\times10^{-5}<T_1<\times10^{-4}$(sec); and $5\times10^{-5}<T_2<\times10^{-4}$(sec);

where $T_1$ is a time duration in which the toner receives force away from said image bearing member toward said developer carrying member; and where $T_2$ is a time duration in which the toner receives force away from said developer carrying member toward said image bearing member.

2. The apparatus according to claim 1, wherein said electric field forming means applies a voltage $V_1$ to said developer carrying member for producing the force for directing the toner away from said image bearing member toward said developer carrying member for the time duration $T_1$ and a voltage $V_2$ for directing the toner away from said developer carrying member toward said image bearing member for the time duration $T_2$.

3. The apparatus according to claim 2, wherein said electric field forming means applies a voltage $V_3$ which is between the voltages $V_1$ and $V_2$ for the time duration $T_3$ after application of the voltage $V_2$ for a time duration $T_2$.

4. The apparatus according to claim 3, wherein the following relationships are satisfied:

$$(T_1+T_2)<T_3<5\times(T_1+T_2).$$

5. The apparatus according to claim 3, wherein the following equation is satisfied:

$$(V_3=(½)\times(V_1+V_2).$$

6. The apparatus according to claim 3, wherein said electric field forming means applies the voltage $V_3$ after applications of the voltages $V_1$ and $V_2$ are repeated a plurality of times.

7. The apparatus according to claim 3, wherein the following relationships are satisfied:

$$V_D<V_3<V_L$$

where voltage $V_L$ is a voltage at an image portion of said image bearing member, and voltage $V_D$ is a voltage at a nonimage voltage portion thereof.

8. The apparatus according to claim 1, wherein said contact charging means charges said image bearing member.

9. The apparatus according to claim 8, wherein said contact charging means includes an electroconductive brush contactable to said image bearing member.

10. The apparatus according to claim 8, wherein said contact charging means has chains of magnetic particles contactable to said image bearing member.

11. The apparatus according to claim 1, wherein said carrier has a volume resistivity of $10^6$ to $10^{10}$ Ωcm.

12. An apparatus according to claim 1, wherein said contact charging means forms an oscillating electric field having a frequency of 100–6000 Hz.

13. An image forming apparatus comprising:

an image bearing member for carrying an electrostatic image, said image bearing member having a surface layer in which low resistance particles are dispersed;

contact charging means for electrically charging said image bearing member while contacting a surface of said image bearing member;

developing means for developing an electrostatic image on said image bearing member with a developer comprising toner and a carrier, while contacting chains of the carrier to said image bearing member, said developing means including a developer carrying member, opposed to said image bearing member, for carrying the developer and electric field forming means for forming an electric field between said image bearing member and said developer carrying member;

wherein the following relationships are satisfied:

$5\times10^{-5}<T_1<1\times10^{-4}$(sec); and $5\times10^{-5}<T_2<1\times10^{-4}$(sec);

where $T_1$ is a time duration in which the toner receives a force away from said image bearing member toward said developer carrying member; and where $T_2$ is a time duration in which the toner receives a force away from said developer carrying member toward said image bearing member.

14. The apparatus according to claim 13, wherein said electric field forming means applies a voltage $V_1$ to said developer carrying member for producing the force for directing the toner away from said image bearing member toward said developer carrying member for the time duration $T_1$ and a voltage $V_2$ for directing the toner away from said developer carrying member toward said image bearing member for the time duration $T_2$.

15. The apparatus according to claim 14, wherein said electric field forming means applies a voltage $V_3$ which is between the voltages $V_1$ and $V_2$ for a time duration $T_3$ after application of the voltage $V_2$ for the time duration $T_2$.

16. The apparatus according to claim 15, wherein the following relationships are satisfied:

$$(T_1+T_2)<T_3<5\times(T_1+T_2).$$

17. The apparatus according to claim 15, wherein the following equation is satisfied:

$$(V_3=(½)\times(V_1+V_2).$$

18. The apparatus according to claim 15, wherein said electric field forming means applies the voltage $V_3$ after applications of the voltages $V_1$ and $V_2$ are repeated plurality of times.

19. The apparatus according to claim 15, wherein the following relationships are satisfied:

$$V_D<V_3<V_L$$

where voltage $V_L$ is a voltage at an image portion of said image bearing member, and voltage $V_D$ is a voltage at a nonimage voltage portion thereof.

20. The apparatus according to claim 13, wherein said contact charging means charges said image bearing member.

21. The apparatus according to claim 13, wherein said contact charging means includes an electroconductive brush contactable to said image bearing member.

22. The apparatus according to claim 13, wherein said contact charging means has chains of magnetic particles contactable to said image bearing member.

23. The apparatus according to claim 13, wherein said image bearing member has a surface layer having a volume resistivity of $10^9$ to $10^{13}$ Ωcm.

24. The apparatus according to claim 13, wherein said carrier has a volume resistivity of $10^6$ to $10^{10}$ Ωcm.

25. An apparatus according to claim 13, wherein said contact charging means forms an oscillating electric field having a frequency of 100–6000 Hz.

* * * * *